US010477302B2

(12) United States Patent
Martincic et al.

(10) Patent No.: US 10,477,302 B2
(45) Date of Patent: Nov. 12, 2019

(54) ACOUSTIC ABSORBER, ACOUSTIC WALL AND METHOD FOR DESIGN AND PRODUCTION

(71) Applicants: UNIVERSITE PARIS-SUD, Orsay (FR); CENTRE NATIONAL DE LA RECHERCHE SCIENTIFIQUE, Paris (FR); UNIVERSITE DU MANS, Le Mans (FR)

(72) Inventors: Emile Martincic, Villejuif (FR); Alexandre Houdouin, Villebon-sur-Yvette (FR); Stéphane Durand, Pruillé-le-Chétif (FR); Nourdin Yaakoubi, Le Mans (FR); Elie Lefeuvre, Montreuil (FR); Yves Auregan, Angers (FR)

(73) Assignees: UNIVERSITE PARIS-SUD, Orsay (FR); CENTRE NATIONAL DE LA RECHERCHE SCIENTIFIQUE, Paris (FR); UNIVERSITE DU MANS, Le Mans (FR)

( * ) Notice: Subject to any disclaimer, the term of this patent is extended or adjusted under 35 U.S.C. 154(b) by 0 days.

(21) Appl. No.: 16/075,926

(22) PCT Filed: Feb. 8, 2017

(86) PCT No.: PCT/EP2017/052787
§ 371 (c)(1),
(2) Date: Aug. 6, 2018

(87) PCT Pub. No.: WO2017/137455
PCT Pub. Date: Aug. 17, 2017

(65) Prior Publication Data

US 2019/0058941 A1 Feb. 21, 2019

(30) Foreign Application Priority Data

Feb. 8, 2016 (FR) ..... 16 50983

(51) Int. Cl.
*E04B 1/82* (2006.01)
*H04R 1/28* (2006.01)
(Continued)

(52) U.S. Cl.
CPC ..... *H04R 1/2896* (2013.01); *E04B 1/86* (2013.01); *G10K 11/16* (2013.01); *H04R 9/06* (2013.01); *E04B 2001/8485* (2013.01)

(58) Field of Classification Search
CPC ..... E04B 1/8409; E04B 9/001; E04B 2001/8414; E04B 2001/8438;
(Continued)

(56) References Cited

U.S. PATENT DOCUMENTS 8,857,563 B1 10/2014 Chang et al.
2006/0147077 A1* 7/2006 Grimani ..... G10K 11/172 381/353
2012/0155688 A1* 6/2012 Wilson ..... G10K 11/168 381/354

OTHER PUBLICATIONS

International Search Report from International Patent Application No. PCT/EP2017/052787, dated May 9, 2017.
(Continued)

*Primary Examiner* — Amir H Etesam
(74) *Attorney, Agent, or Firm* — Greer, Burns & Crain, Ltd.

(57) ABSTRACT

A passive sound absorber includes a cavity opening to the outside via an input direction to form a Helmholtz resonator for a first frequency. The absorber further includes at least one moving element, or wafer, suspended or held by suspensions in a position obstructing the neck in a non-sealed manner. The relative stiffness of the suspensions and the wafer is determined so that the assembly resonates in a vibration in a "piston" movement at a second frequency different from the first frequency, achieving absorption for
(Continued)

this second frequency or frequency range. A hybrid version includes a coil that is controlled to adjust the acoustic impedance of the absorber.
An acoustic wall includes a plurality of such absorbers produced by a repetitive structure opening through perforations, each receiving such a wafer, and a method of designing and manufacturing such an absorber or wall is also provided.

16 Claims, 5 Drawing Sheets

(51) Int. Cl.

| | |
|---|---|
| ***G10K 11/16*** | (2006.01) |
| ***E04B 1/86*** | (2006.01) |
| ***H04R 9/06*** | (2006.01) |
| *E04B 1/84* | (2006.01) |

(58) Field of Classification Search
CPC .. G10K 11/162; G10K 11/168; H04R 1/2807; H04R 1/28; H04R 1/2803; H04R 1/288; H04R 29/001; H04R 21/02
See application file for complete search history.

(56) References Cited

OTHER PUBLICATIONS

Written Opinion of the International Searching Authority from International Patent Application No. PCT/EP2017/052787, dated May 9, 2017.

* cited by examiner

Fig. 10a
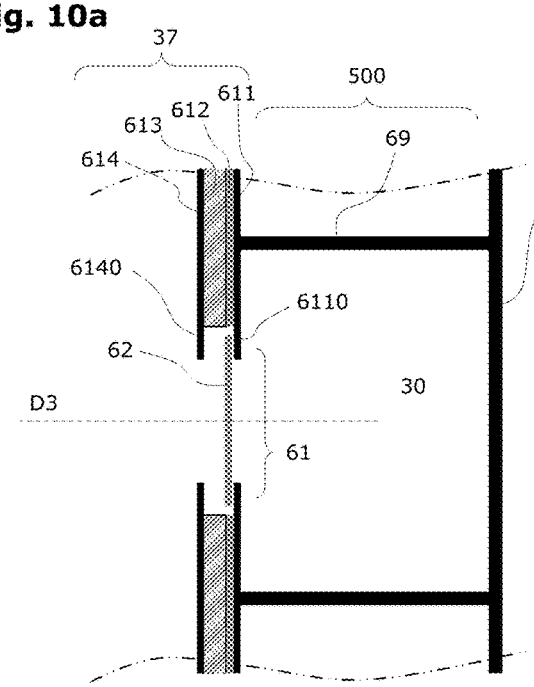
Fig. 10b
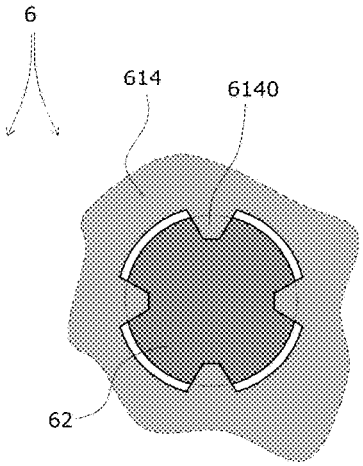
Fig. 11a
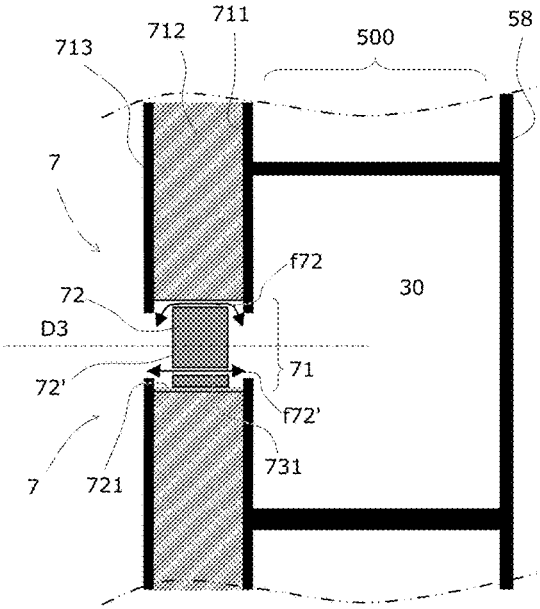
Fig. 11b
Fig. 12
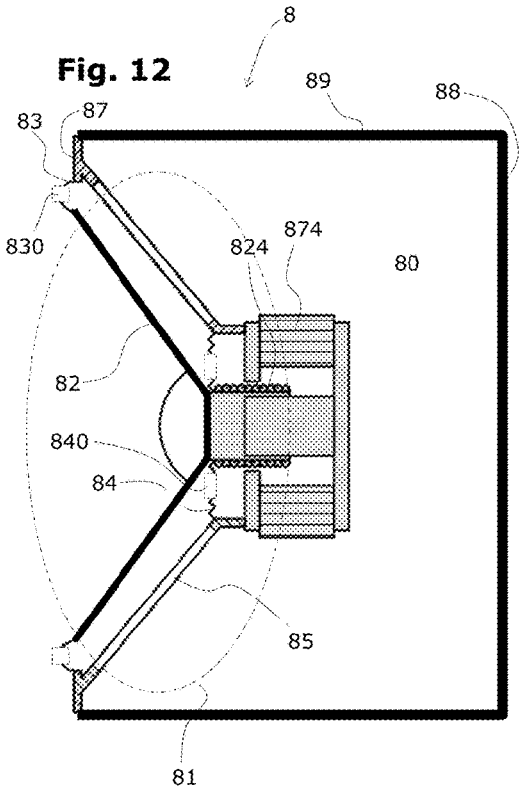

Fig. 13a
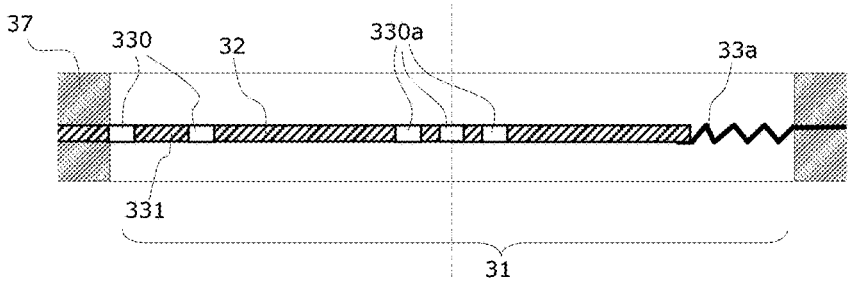
Fig. 13b
Fig. 14a
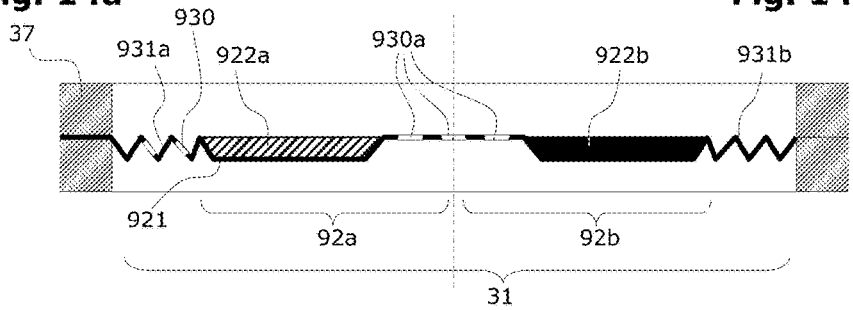
Fig. 14b
Fig. 15a
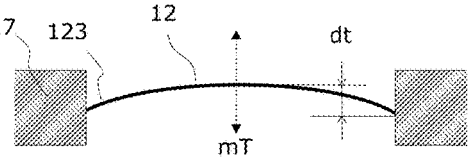
Fig. 15b
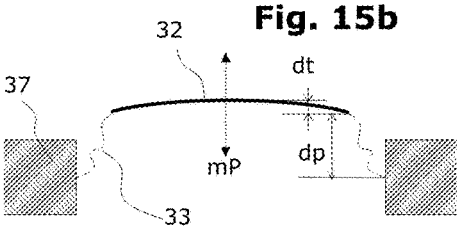
Fig. 16
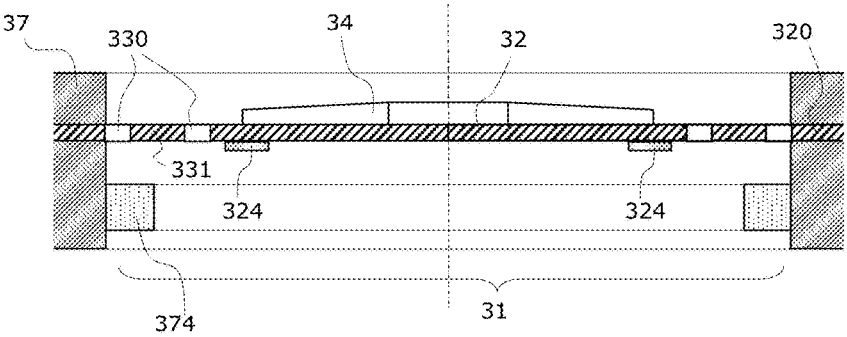

ACOUSTIC ABSORBER, ACOUSTIC WALL AND METHOD FOR DESIGN AND PRODUCTION

BACKGROUND

The invention relates to a passive sound absorber comprising a cavity opening to the outside in the direction where the acoustic wave in incident via a neck passing through the front wall in order to form a Helmholtz resonator for a first frequency. According to the invention, said absorber further comprises at least one moving element, or wafer, suspended or held by suspensions in a position obstructing said neck in a non-sealed manner.

In addition, the relative stiffness of the suspensions and of the wafer is determined such that the assembly of the wafer and the suspension arms vibrates in a "piston" type resonant mode at a second frequency different from the first frequency, thus producing an absorption for said second frequency or range of frequencies. This second frequency is located between the first frequency and a third frequency which is the frequency of the whole wafer with its suspension when measured in the open air.

Additionally, a hybrid version comprises a coil that is controlled to adjust the acoustic impedance of the absorber.

The invention proposes an acoustic wall comprising a plurality of such absorbers produced by a repetitive structure opening through perforations, each receiving such a wafer.

It also proposes a method for designing and producing such an absorber or wall.

Noise is an important source of noise pollution. Passive noise reduction solutions such as foams are widely applied in most areas.

Passive solutions using Helmholtz resonators are also widely applied, in particular to avoid reflections that can be sources of acoustic resonances. For example, acoustic vases were placed under the stands of Greek or Roman theatres to avoid reflections and improve the acoustics of the building. The size and shape of the vase were adjusted to obtain a resonant system that allowed to suppress acoustic wave reflection in the stands. Nowadays, similar devices are present in the jet engine nacelles.

This system is based on the acoustic resonance of the cavity, which can be described as a "resonant cavity". The functioning of resonant cavities was conceptualised much later and is now called the "Helmholtz resonator".

As shown in FIG. 1, the Helmholtz 1 resonator is an open air cavity comparable to an open bottle composed of a neck 11 and a rear volume 10. In the figure, this cavity 10 is enclosed in side walls 19, a bottom wall 18 and a front wall 17, and is only open in the direction A11 via an orifice passing through the front wall 17. This orifice forms a "neck" 11 that has a certain length and thus delimits a volume which is defined by the length L11 of the neck and its opening surface A11, for example, a circular surface that forms a cylindrical neck.

In such a device, the volume of the neck 11 and the rear volume 10 of the cavity are comparable respectively to the mass and the stiffness of a mechanical oscillatory system with one degree of freedom. The absorption is then produced by converting the pressure variation resulting from the acoustic wave into a fluid movement. The energy of the acoustic wave at the resonance frequency of the resonator is then transferred to the resonant system. To attenuate an acoustic wave of a given frequency, the Helmholtz resonator is sized so that its natural frequency is adapted to this frequency to be attenuated according to the following formula:

$$f_0 = \frac{c_0}{2\pi}\sqrt{\frac{A_{col}}{L_{col}V_{cavité}}}$$

where Aneck=$\pi \cdot r^2$, Lneck and Vcavity are respectively the surface A11 of the opening, the length L11 of the neck 11 and the volume V10 of the rear cavity 10.

Recently, active solutions have been developed that use acoustic transmitters activated and operated according to the acoustic wave to be attenuated for producing destructive interferences that decrease their intensity. However, this type of solution is complex, fragile and expensive.

The choice of a noise reduction device is made according to the cost of the solution to be used, the space requirements and other constraints, such as the operating temperature, as in the case of reducing the noise of plane reactors.

In case of noise compensation in large spaces, such as theatres or traffic halls, the cost of an active absorbing acoustic wall is difficult to predict. Helmholtz resonators or the use of localised active noise compensators make it possible to limit the nuisances specifically related to acoustic resonance modes.

In aircraft reactors, where sound production is very important, civil aviation standards impose increasingly severe restrictions on the emission of aircraft noise. Among all the possible noise reduction solutions, only passive solutions are possible in reactors, due to the very high demands on temperature and vibrations, which can be both acoustic and mechanical.

Instead of using foam, or as an additional solution, cavities tuned as Helmholtz resonators are currently implanted on reactor walls, as shown in FIG. 2. These cavities 10 are made using plates 20 forming a periodic structure in the shape of a honeycomb, as shown in FIG. 2. Such a plate 20 is enclosed between a solid rear plate 28 and a front plate 27. It is pierced with holes 11 opening into cells 10, every one of which constitutes the neck of a resonator 1. This structure allows to adapt the obtained assembly 2 to the shape of the outer wall of the reactor and to ensure its rigidity.

Other passive solutions have been proposed, for instance in document U.S. Pat. No. 8,857,563, which proposes a Helmholtz cavity whose front and/or rear walls are formed of flexible membranes fixed inside the neck, thus deforming one or several walls. These flexible walls sometimes have an orifice and can be equipped with a ballast which allows to change the acoustic response of the walls and of the entire cavity. It has also been proposed to combine Helmholtz cavities with porous materials.

In US 2012/0155688, it is proposed to make a rigid plate of open-cell absorbent which absorbs a first frequency, and to use the flexural stiffness of this plate to absorb a second frequency. In one particular variation, this document also proposes to cut into the plate openings, which can form Helmholtz cavities as known in the state of the art.

One of the purposes of the invention is to overcome the disadvantages of the prior art. This invention seeks improvements, in particular in terms of absorption performance, as well as when it comes to the width and positioning of attenuated frequency ranges. It also seeks to improve the flexibility of implementation and adaptation, that is including the flexibility of design when it comes to the frequencies to be absorbed, for spectrum width and at lower frequencies. Cost, simplicity and reliability as well as resistance to external stresses are also sought after.

SUMMARY

The invention proposes an acoustic absorber device, notably a passive device, comprising a rigid enclosure delimiting a cavity, which is closed around its periphery except in a so-called input direction (generally a single one) through which this cavity opens outwards. This outlet is composed of at least one orifice passing through a so-called front wall that is rigid and of a determined thickness, thus forming at least one neck with a specified opening surface and a specified length. In such an enclosure, this neck therefore presents a fixed shape and position, as well as invariant dimensions. The dimensions of said enclosure and of said neck are typically determined by the volume of the enclosure as well as by the surface and the length of the neck, together forming a Helmholtz resonator for an incident wave of a first frequency or frequency range, known as natural frequency.

Optionally, this neck is distributed in several orifices opening into the same cavity so that the assembly behaves like a single Helmholtz resonator, where the orifices mostly open in the same direction or in essentially parallel directions, for instance that form an angle of less than 30° or 15°.

According to the invention, this absorber further comprises at least one movable element, here referred to as wafer, suspended to said enclosure by one or more mechanical connections, here referred to as suspensions (e.g. through a continuity of material(s)) in a position obstructing at least partially said at least one said neck, in unsealed manner on at least a portion of its stroke. I.e. there remains a leakage section on at least a portion of the movement stroke, or on the entire stroke.

In some embodiments, there is a permanent leakage section. In this case, the movable element may or may not remain inside the neck across its entire stroke.

According to other embodiments, the movable element can also obstruct the cavity in a sealed manner when it is located inside the neck, but have a portion of its stroke where a leakage section appears, for example at both ends of its stroke or at least one of them.

In addition, according to the invention, the stiffness of the suspensions together with the stiffness of the wafer is determined (or in its ratio) so that said wafer vibrates in a "piston" type resonance mode along the direction of the incident wave, at a second frequency or frequency range different from the first frequency (particularly a lower frequency), thus achieving absorption for this second frequency or frequency range.

To achieve such an obstruction, the wafer can be positioned in various places with respect to the neck, either inside or in front of it, inside or outside, and in a way that can vary during its movement.

Typically, the suspended wafer is positioned so that the suspension of the absorber, tested or calculated once loaded, i.e. with the wafer but in the open air outside the cavity, has a third frequency resonance which is different from the first frequency. The second frequency, obtained by assembling the cavity and the suspended wafer, will thus be located between the first frequency (i.e. the Helmholtz frequency of the cavity) and the third frequency (that of the suspended wafer, measured in open air).

The third frequency is preferably lower than the first frequency. The second frequency, located between the two, is also lower than the Helmholtz frequency.

Alternately, the third frequency is higher than the first frequency. The second frequency, situated between the two, is therefore also higher than the Helmholtz frequency.

Preferably, the wafer occupies a section of at least 80% of the neck section. In case of a wafer formed by a piece of non-uniform stiffness, this piece has a part that moves in piston mode and forms said wafer, on a section of at least 80% of the neck section.

Such displacement in "piston mode" is defined here, for a two-dimensional object, as a movement perpendicular to its average surface in which the object has a deformation that is very small or even negligible in relation to this movement. I.e. with a simultaneous movement of all its parts in the same direction and at identical or very close speeds, and therefore with little or no flexion.

Such movement in "piston" mode is different from movement in "drum" mode for instance, in which deformation is distributed over the entire surface of the object. Thus, a flexible membrane with a constant thickness fixed on its periphery will deform in drum mode, just like in the example of the flexible walls proposed in U.S. Pat. No. 8,857,563.

For example, if the natural frequency of the wafer+suspension arms is lower than that of the Helmholtz resonator alone, the resulting absorption frequency of this absorber will be lower than that of the Helmholtz resonator.

Preferably, the characteristics of the wafer and its suspensions are determined so that their natural resonance frequency, i.e. mounted in the open air and without a cavity, is located below the Helmholtz frequency of said cavity.

Indeed, while conducting tests for implanting a sealed type speaker in the neck of a Helmholtz resonator, the inventors found improvements and specific changes in the behaviour of this assembly when used in passive mode, i.e. without activating the speaker.

Thus, it has been found that the addition of such a wafer, in particular arranged to vibrate in piston mode, surprisingly modifies the behaviour of the cavity: the absorption is significantly more efficient, and the system also has a shift of its absorption frequency towards lower frequencies.

Preferably, but not necessary, the geometry or the material (preferably both) of the wafer is (are) designed to form a rigid structure, i.e. with high stiffness and which is less easily deformed compared to its average movement in piston mode, and/or with respect to the dimensions of the neck, e.g. less than 10% or less than 50%. It is preferably a purely elastic structure with little or no hysteresis.

According to one particularity, the wafer is made of a material and a structure with a low weight, preferably combined with high stiffness.

The wafer, for instance, is made of one or more materials selected amongst silicon, quartz, alumina ($Al_2O_3$), titanium and its alloys, steel, aluminium and its alloys, plastics and notably polymers.

The suspensions are preferably made using a material and geometrical shape that provide elastic behaviour. According to an example of embodiment with good results, for a silicon structure, the stiffness of the suspension, calculated for the displacement of the wafer in its periphery, is less than 6 N/m, and particularly less than 2 N/m; for example between 0.5 and 20 N/m, or even between 2 and 6 N/m for a round wafer that is between 10 and 20 mm in diameter.

According to one feature, the wafer has a two-dimensional thin shape, for example flat, and preferably has a periphery that is substantially parallel to the edge of the neck, for example providing a leakage section regularly or evenly distributed around the wafer.

Preferably, the suspension and the leakage section are positioned so that the whole moving equipment does not have a mode of torsional deformation at the frequency to be absorbed, and preferably not below it either. According to one feature, the geometry of this periphery and its deviation from the neck are determined so as to compensate or avoid torsional deformation of the wafer, for example in adjustment phase, for example in case of a neck with a periphery that does not form a complete circle or is not regular.

According to another particularity, the suspensions comprise elongated arms connecting the wafer to the enclosure in a shape extending around said wafer parallel (or at least making an average angle of less than) 20° to the edge of the neck and/or the wafer. This type of geometry thus makes it possible to obtain great flexibility by maintaining a small gap between the neck and the wafer while limiting or avoiding the torsion modes of the structure.

Thus, for an elastic material of a given stiffness, it is possible to produce arms of greater length, and therefore of a lower stiffness, while limiting clutter around the periphery of the wafer, and therefore limiting the gap between it and the wall of the neck or by limiting the constraints that weigh on the gap that can be present. Indeed, great flexibility is difficult to obtain given a small gap, especially in a regular manner around the wafer; while it is useful for limiting the occurrence of torsion modes and favouring the piston mode.

For example, the wafer is formed within a plate or a plate that is integral to the enclosure, by a portion rendered mobile with respect to said enclosure by means of one or more cuts made in said plate or sheet so as to form suspension arms.

It is thus easier to industrialise manufacturing, which can become faster, more accurate, more repeatable and less expensive.

According to another particularity, the wafer is held in the neck by one or more protrusions from the neck at both ends to extend in front of the periphery of the wafer so as to form a stop preventing said wafer from escaping the neck.

According to yet another particularity, where suspension is with or without a connection through material continuity, the wafer has a periphery that matches the inner surface of the neck, with a determined gap, over a length determined depending on the direction of its vibration movement. This length is determined to be sufficient, in combination with said gap and with the nature of the materials of the neck and the wafer, to allow said wafer to move along the neck without causing blocking by tilting and arching. Such a wafer is for example in the form of a cylinder, forming a complete circle or not.

Such an absorber can thus be produced in a variety of sizes and in a manner that is easy to industrialise, including small ones, for example in dimensions that are compatible with current honeycomb configurations whose housings are compatible with the space requirement and the resonance frequencies used in the field of aviation or industrial machinery.

Alternatively, depending on the invention an absorber comprises a wafer formed by a loudspeaker membrane (for example a resin such as kevlar, fabric, paper or cardboard), for example a conventional voice coil type electrodynamic loudspeaker and annular permanent magnet(s). Typically, this membrane fixed to an outer frame by means of a flexible peripheral seal, for example of a type conventionally used to produce a flexible peripheral suspension that forms a loudspeaker seal at the same time, for example rubber or latex, elastomer, thin polymer film such as a polyethylene film of about 100 μm.

According to the invention, this seal has one or more cuts surrounding said membrane to place the neck at its periphery. The cuts may have large dimensions, representing the majority of the seal surface (for example at least 20% or even at least 40%), provided that the mechanical solidarity of the membrane to the frame is ensured by the seal alone or possibly with the spider.

According to one feature, this structure is made without including the usual electromagnetic system, for example a coil and a magnet. Such an absorber is thus easy to produce, with well known techniques that have been proven to be economical in terms of manufacture and assembly, for example in the context of acoustic walls for rooms in a building, with greater efficiency and/or bulkiness than with conventional Helmholtz resonators while being lower in cost than a true active absorption facility.

Hybrid Absorber with Reactive or Active Control

In some embodiments, that may combine all or some of the particularities disclosed herein, the wafer further interacts with the enclosure (and the neck, for example) via an electromagnetic system to form a speaker membrane.

Preferably, the coil is fixated on the wafer, while the permanent magnet(s) is/are fixed on the neck or the front wall. Compared to the case where the permanent magnet is mobile, this provides greater freedom of design, and in particular better efficiency and possible absorption in lower frequencies.

Alternatively or additionally, the permanent magnet is attached to the wafer and the coil is attached to the neck.

This gives an absorber that can be qualified as hybrid, in the sense that it combines the advantages of passive reduction with controlled management of its impedance.

Active acoustic systems can be separated into two categories:

- active controlled systems with a servoing chain, that require the introduction of a control measure (pressure and/or speed), and
- reactive systems control measures that do not require to measure the characteristics of the acoustic wave to absorb.

In these embodiments, the electromagnetic system is controlled by an electronic circuit:

- in order to achieve active acoustic absorption, and/or
- so as to modify the acoustic impedance of said loudspeaker so as to enhance absorption, shift the absorption frequency, widen the absorption frequency range, or a combination of these effects.

In a first so-called "reactive" electromagnetic version, the hybrid absorber with leakage section of the invention is controlled by an electronic circuit so as to achieve active acoustic reduction, typically by applying a "negative impedance" shunt at the terminals of the voice coil, with or without the control measures of the value of the negative impedance. This gives a reactive-only system, which offers possibilities for controlling the behaviour of the absorber, without implementing all the complexity of conventional active reduction electronics. Indeed, obtaining a negative impedance is a simple form of active control techniques.

In a second electromagnetic version forming a truly "active" system, according to the invention, the hybrid absorber with leakage section is controlled by a control measure based on the level and the sound spectrum of the environment to be protected, and using complex control laws, with or without real-time assessment of the resulting sound environment.

These two methods lead to modifying the acoustic impedance of the loudspeaker formed in this way.

This change in acoustic impedance makes it possible to either enhance absorption, shift the absorption frequency, broaden the absorption frequency range, or provide a combination of these effects.

This electronically controlled adaptation of acoustic impedance has already been proposed for conventional speakers with a sealed membrane. The examples mode of control and operation, as well as the obtained results are detailed in the following documents:

Romain Boulandet's thesis: H. Lissek, "Active materials with variable acoustic properties". PhD thesis, Laboratory of Acoustics, University of Maine, 2002;

Romain Boulandet, Hervé Lissek, "acoustic impedance synthesis at the diaphragm of moving coil loudspeakers using output feedback control", ICSV18, 10-14 Jul. 2011, Rio de Janeiro, Brazil;

Romain Boulandet, Herve Lissek, Etienne Rivet. "Advanced control for modifying the acoustic impedance at the diaphragm of a loudspeaker".

French Society of Acoustics. Acoustics 2012, April 2012, Nantes, France. <hal-00810907>

The invention thus makes it possible to provide effective passive absorption in a given frequency range, while also allowing active impedance adaptation allowing absorption over a much wider spectrum.

An installation including such a hybrid absorber with leakage section also allows to use it in active reduction mode or even as an alternative speaker alone, possibly combined or alternated with each other or with the passive or adapted absorption, depending on the installed configuration and depending the chosen moment.

According to another aspect of the invention, a plurality of absorption devices are proposed, as described herein, which are juxtaposed within a continuous two-dimensional array to achieve acoustic absorption in the same direction. A passive or hybrid acoustic absorption wall is also proposed that would comprise a plurality of absorption devices as described here, which are distributed or even juxtaposed within a continuous two-dimensional assembly, to achieve acoustic absorption in the same direction perpendicular to the surface of this wall.

According to a variation, such devices are for example made identical to each other in order to enhance the absorption in a relatively narrow frequency band, and to level it over the entire surface of the wall.

According to another variation, the wall comprises several absorption devices with different characteristics, thus providing absorption on a wider band forming a gathering of absorption bands of different types of devices.

Depending on the configurations and requirements, these absorbers are evenly distributed to form a periodic pattern, either in a repetitive but non-periodical manner, or pseudo-randomly.

According to yet another variation, absorbers according to the invention (of one or more types) are used in the same wall together with other absorbers according to the prior art (for example, Helmholtz cavities with a wafer-devoid neck). These different types can be distributed according to the need for absorption intensity for each frequency, and/or according to the locations concerned by each different frequency.

According to a particularity, such a wall comprises a plate having a repetitive or periodic structure, for example honeycomb, whose housing form a multitude of cavities that are closed on a so-called rear side, typically by a rigid and sealed wall which is integral with the repetitively structured plate. On a front face opposite the rear face, the cavities of this repetitively structured plate are covered by a wall (or several superimposed walls) which is (are) cut so as to form a multitude of necks each receiving a wafer.

According to yet another aspect of the invention, a method for designing and/or industrialising an acoustic absorber as described herein is proposed, intended to absorb a target frequency, characterised as comprising:

- a step of determining the dimensions of a Helmholtz cavity having a first Helmholtz resonance frequency higher than the target frequency, and
- a step of determining (by calculation or experimentation) the characteristics of a suspended wafer (its materials and its geometry) designed to be placed in the neck of said cavity so as to produce an absorber tuned to a second frequency corresponding to said target frequency.

It is preferable that the characteristics of the wafer and its suspensions are defined so that the natural resonant frequency of the mobile unit, i.e. the assembly formed by the wafer and its suspensions, when mounted in the open air and without a cavity, is located below the Helmholtz frequency of said cavity and below said target frequency.

According to another preferred particularity, preferably combined with the previous one, the suspended wafer is configured so that the suspension of the absorber, tested or calculated once loaded, i.e. with the wafer but in the open air outside the cavity, has its first normal mode of deformation at a frequency lower than the second frequency, and therefore lower than the frequency to be absorbed.

More specifically, the wafer itself is defined so that when it is tested or calculated alone, i.e. free and without suspension, its first normal mode of deformation occurs at a frequency that is higher than the second frequency.

It is thus possible to limit or avoid recreating additional noise that might appear at a frequency forming a harmonic wave with the frequency to be absorbed.

The term "first normal mode" mentioned here is to be understood as designating the mode which appears first when the frequency increases, i.e. the mode of deformation which appears at the resonant frequency.

According to yet another aspect of the invention, a method of manufacturing an absorber or a wall, as described here, is proposed. According to the invention, this method comprises at least one step of manufacturing a sheet or a plate so as to form one or more acoustic absorber wafers, for example by subtraction such as laser cutting, water jet, electro erosion, chemical etching or plasma. As an alternative or additional option, this manufacture can also be carried out by additive manufacturing methods, for example by hot deposition, laser polymerisation, laser sintering, for example using polymer or metal. In the embodiments comprising a wafer suspended by suspension arms, the step of manufacturing the wafer also preferably creates an opening in a pattern forming the contours of these suspension arms.

According to one feature, the sheet or plate is attached to the surface of a plate with a repetitive or periodic structure, and the cutting step produces a multitude of wafers distributed with regard to the housing of the periodic structure so as to form the multitude of wafers of an acoustic wall as presented herein.

EXAMPLES OF APPLICATIONS

The invention makes it possible to achieve more effective acoustic absorption than with conventional Helmholtz resonators, within a passive system with all the advantages that this entails, and involving little or no cost, complexity or fragility, especially for low frequencies, for example between 500 Hz and 1500 Hz.

In addition, the downward shift of the natural frequency makes it possible to absorb lower frequencies compared to a conventional resonator, and/or by using a smaller volume since it increases when the frequency to be absorbed decreases.

This type of solution is intended in particular for certain applications where foams or active type solutions cannot or be used or only in a limited way, for example because of the space required to obtain sufficient absorption, or because of their insufficient resistance to difficult conditions, for example climatic, or to an extreme artificial environment. Significant improvements can be made in these areas, which are currently not always accessible otherwise.

By way of example, it is planned to achieve acoustic absorption in aircraft engines, in an improved manner with respect to simple perforation honeycomb structures illustrated in FIG. 2, and for example to respond to changes in the standards of civil aviation, which impose a less and less aircraft noise emission.

Many applications are being considered for improving and/or making the insulation of many systems or machines less cumbersome, for example machine tools or elements of production lines, robotised or not.

Interesting applications are also being considered in the field of construction, notably to limit the echo in large covered or closed spaces, for example recording studios or large conference rooms or shows, traffic or passage halls.

Various embodiments of the invention are proposed, integrating the various optional features set forth herein, according to all their possible combination.

BRIEF DESCRIPTION OF THE DRAWINGS

Other features and advantages of the invention will emerge from the detailed description of an embodiment, which is in no way limiting, as well as the appended drawings where:

FIGS. 10*a* and *b* are schematic views, in axial section and seen from the left side, which illustrate one of the absorbers within a honeycomb acoustic wall, according to a fourth example of embodiment of the invention, with a free wafer retained by outer layers protruding above the neck;

FIGS. 11*a* and 11*b* are schematic half-views in axial section, which illustrate one of the absorbers of a honeycomb acoustic wall, according to two variations of a fifth example of embodiment of the invention, with a thick unfixed wafer retained by external layers protruding above the neck;

FIG. 12 is a schematic view in axial section which illustrates a sixth example of the invention embodiment with a conical diaphragm-shaped electrodynamic loudspeaker mounted on perforated peripheral joints; wherein the leakage section is formed by orifices passing through the inside of the membrane, in two half-views presenting different variations;

FIG. 13 is a schematic view in axial section which illustrates a seventh example of the embodiment with a rigid wafer having a leakage section in its inner part, where the leakage section is formed by orifices passing through the inside of the wafer, presenting two half-views with different variations;

in FIG. 13*a*, with unsealed suspension, and in FIG. 13*b*, with waterproof suspension;

FIG. 14 is a schematic view in axial section which illustrates an eighth example of a flexible centre wafer embodiment of including a leakage section, wherein the leakage section is formed by orifices passing through the inside of the wafer, in two half-views presenting different variations;

in FIG. 14*a*, with unsealed suspension, and in FIG. 14*b*, with sealed suspension;

FIG. 15 is a diagram illustrating the difference between a movement:

in FIG. 15*a*, in "piston" mode, and in FIG. 15*b*, in "drum" mode;

FIG. 16 is a schematic axial sectional view which illustrates the neck and the wafer of the absorber of FIG. 3, in a version with its electromagnetic coil and stiffeners as shown in FIG. 5.

DETAILED DESCRIPTION

Single Absorber

Figure 1:
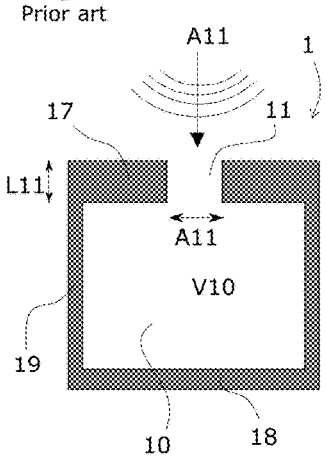
Fig. 1 Prior art
FIG. 1 is a diagram in axial section which illustrates a Helmholtz resonator according to the state of the art.
Figure 2A:
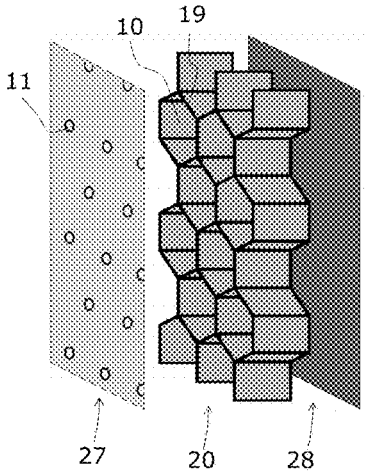
Fig. 2a Prior art
FIGS. 2*a* and *b* are perspective diagrams that illustrate an acoustic wall according to the state of the art, comprising a multitude of Helmholtz resonators, formed by a honeycomb structure covered with a perforated plate, before and after assembly.
Figure 2B:
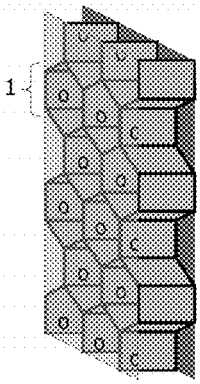
Fig. 2b Prior art

FIG. 1 to FIG. 7 illustrate a first example of embodiment of the invention. For the other examples, only their differences from the first embodiment will be described.

In this first example of embodiment, the absorber 3 was made and tested in the context of research originally intended to achieve an active reduction system by loudspeaker.

The absorber 3 has the form of a cylinder delimiting an interior cavity 30. This cavity 30 is surrounded by a cylindrical wall 39, it is entirely closed by a rear flat wall 38 and partially by a front wall 37. The latter is pierced with a central orifice opening in a axial D3 direction towards the cylinder of the cavity 30. This orifice has a cylindrical shape through the thickness of the front wall 37, and thus forms a neck 31 of L31 length and with A31 cross section.

In the example described here, the used wafer is formed by the silicon membrane of an electrodynamic micro-speaker made using MEMS technology (for Micro Electro Mechanical Systems), as described in Iman Shahosseini's thesis, "Towards micro high-performance electroacoustic loudspeakers in silicon technology", PhD thesis, Institute of Basic Electronics, 2012, or in I. Shahosseini et al.," Towards high fidelity high efficiency mems microspeakers, "IEEE International conference on sensors, pp. 2426-2430, 2010 . . . . These electrodynamic micro-HP silicon has the characteristic feature of being less than one centimeter thick and having a resonance frequency comparable to that of a conventional midrange speaker (500 Hz), which allows good integration into a thin environment, for example into a wall of less than 50 mm.

Figure 4:
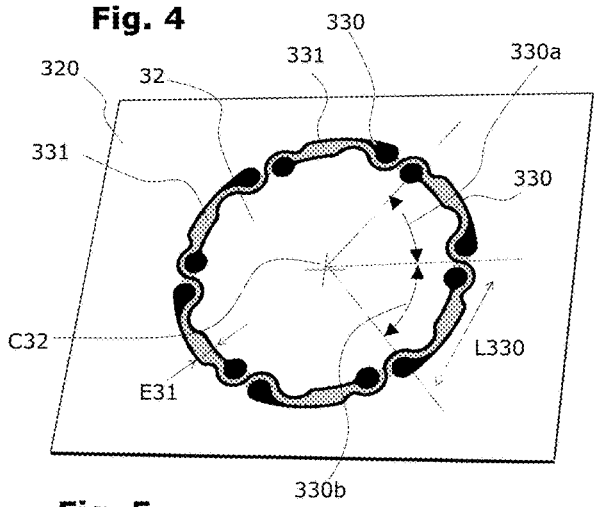
FIG. 4 is a scale perspective view illustrating the cuts forming the suspensions and the absorber wafer of FIG. 3.

As illustrated in FIG. 4, the wafer 32 is formed by an inner part cut out of a rigid plate 320. This cutout is made in a pattern comprising several cutouts 330 which surround the wafer 32 almost entirely. In this example, several essentially linear (i.e. one-dimensional) cutouts 330 are made at angles distributed regularly around the centre C32 of the wafer, here in six identical cuts. Each of these cutouts 330 covers an angular part of the periphery away from the centre 32 by a specific distance, which corresponds to the width of the arms and the distance E31 between the periphery of the mobile wafer 325 and the wall of the neck 31. Each of these cuts extends partially along its neighbours, inward and in one direction (here: in the counter-clockwise direction) and outward in the other direction (here: clockwise). Thus, between each group of two cuts side by side, the remaining material forms a spirally developing arm extending along the periphery of the wafer, over a length L330 that is much larger than the gap E31 between the neck and the wafer. It is thus possible to obtain arms 331 (in grey in the figure), of great length and therefore of low stiffness, despite the rigidity of the material of the initial plate 320.

In this example, the initial plate 320 is made of silicon with a total thickness of 20 μm and outer dimensions of 23 mm×28 mm, monocrystalline silicon for example, that can be obtained from an SOI-type substrate. The wafer 32 cut out inside this plate has a diameter of 13 mm, and the cutouts 330 have a width of around 20 μm. At both ends, the cutouts 330 widen into a circular shape (in black in FIG. 4 and FIG. 5) to limit the fatigue of the material and to avoid cracks.

Figure 5:
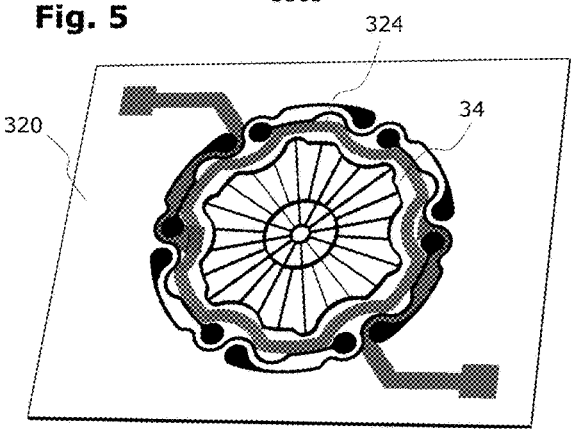
FIG. 5 is a scale perspective view illustrating the wafer of the absorber of FIG. 3, in a version with its electromagnetic coil and stiffeners.

As illustrated in FIG. 5, this wafer also carries stiffeners 34, made using methods known in the field of MEMS, formed by ribs protruding from its surface over a certain height, here 300 μm. The total thickness of the wafer, when it comes to its rigidity, is therefore 320 μm.

As part of this experiment, the loudspeaker thus produced further comprises a series of electrical tracks deposited on the periphery of the wafer to form an electromagnetic coil (optional) 324 which are connected to the fixed part by two of the 20 μm-thick suspension arms 331 that are also formed by cutting into the initial plate 320.

Figure 3:
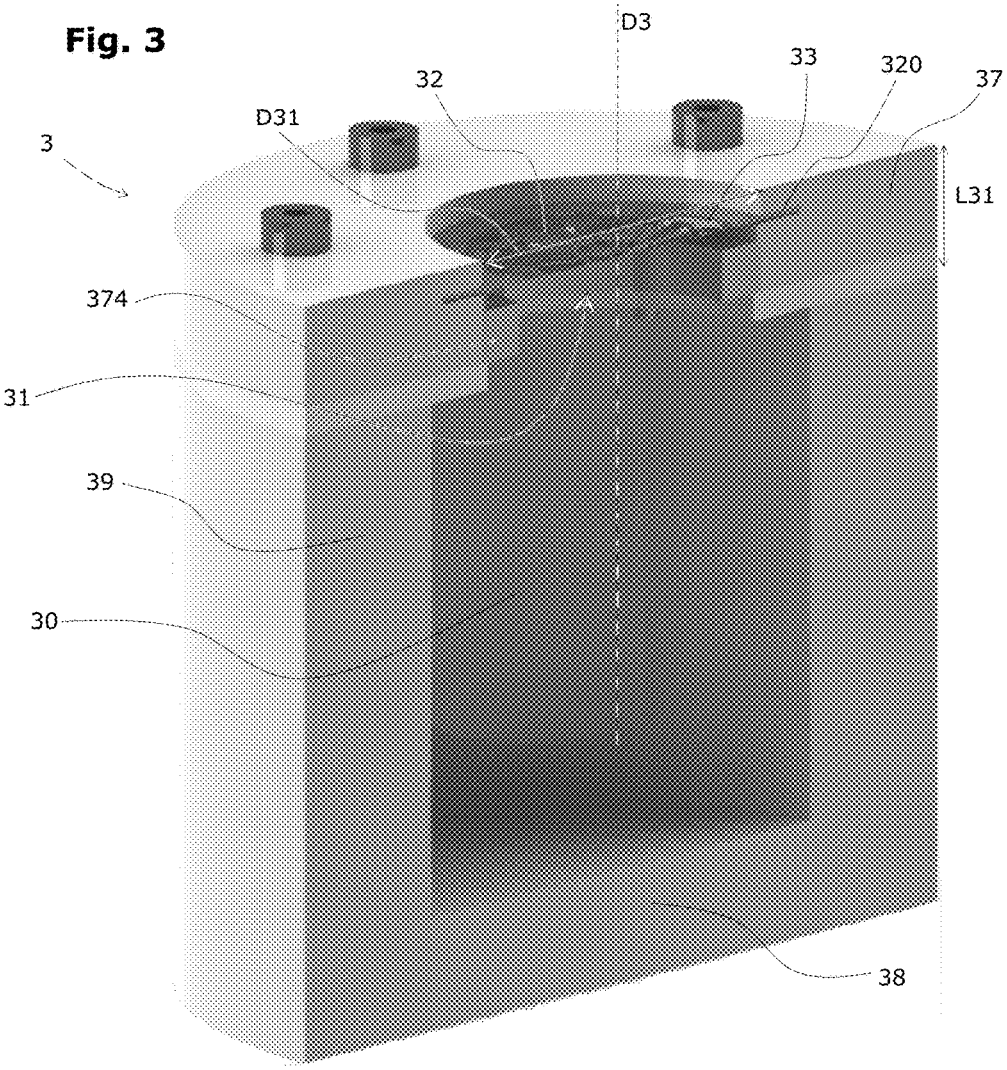
FIG. 3 is a perspective view of an axial section of an absorber according to the first embodiment of the invention, comprising a cavity of 21 $cm^3$ with electrodynamic silicon wafer.

As illustrated in FIG. 3, the electromagnetic system of this loudspeaker is completed by a permanent annular magnet 374, fixed inside the neck 31 to interact with the coil 324. This magnet can be composed of two Neodymium Iron Boron ring magnets whose theoretical polarisation value is 1.5 T, as described in the Shahosseini thesis.

Figure 6:
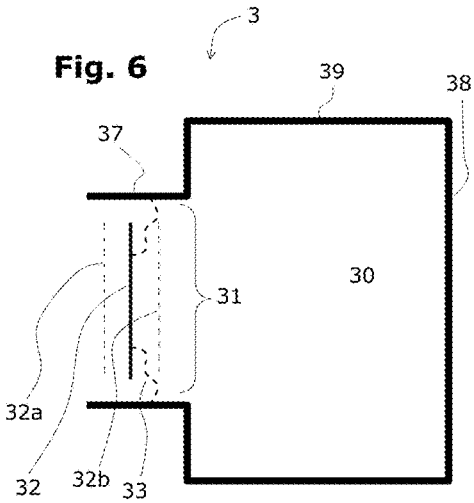
FIG. 6 is a schematic view in principle, in axial section, of an absorber defined by the invention, in a configuration where the neck is more narrow than the cavity.

FIG. 6 is a schematic diagram illustrating this absorber 3, with a suspension 33 which is not sealed and of a very low stiffness (in dashed rounded lines) which can be considered as negligible compared to the stiffness of the wafer 32 (and therefore favouring the piston mode), despite the fact that the suspension and the wafer are formed by the same initial plate.

Figure 7:
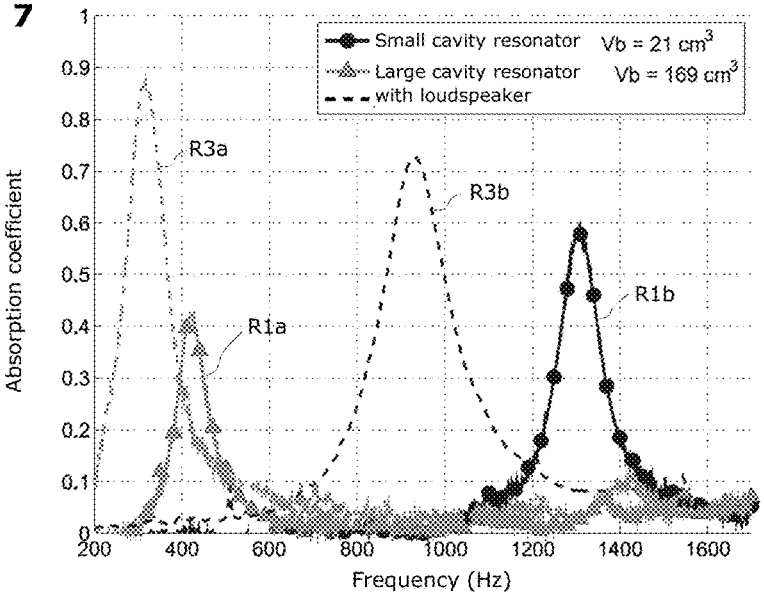
FIG. 7 is a graph illustrating absorption curves experimentally obtained using the absorber of FIG. 3 and for two different cavity volumes, in a configuration with and without a seal around the wafer.

In passive mode, in the tests carried out and illustrated in FIG. 7, the wafer vibrates in piston mode by moving between the extreme positions 32*a* and 32*b* (dashed lines in FIG. 6). The amplitude of these movements corresponds to a maximum movement of less than 2 mm from the equilibrium position (solid line), and the suspension allows a movement without breakup to up to approximately 4 mm.

Initially, the experiments aimed at achieving active reduction by activating the loudspeaker according to an electronic control aimed at attenuating frequencies close to the Helmholtz resonance frequency of cavity 30 on which it was mounted. This work was done in the framework of Alexandre Houdouin's thesis of the IEF in 2014, that has not yet been published. To avoid acoustic short circuits, as it is natural when one seeks to optimise the efficiency of a loudspeaker, it was planned to close the gap E31 by a continuous and sealed peripheral seal. Several types of joints had been considered, for example cast latex or a thermo-formed polyethylene film.

However, various tests were carried out at different completion stages of the envisaged system, including before mounting this seal.

The following table presents the geometrical values of the cavity 30 and the neck 31, as well as the calculated and measured resonant frequencies, for the two tested cavities and without the wafer.

| Parameters | Small cavity | Large cavity | Units |
|---|---|---|---|
| $R_{neck}$ | 0.8 | 0.8 | cm |
| $A_{neck}$ | 2.0 | 2.0 | $cm^2$ |
| $L_{neck}$ | 1.6 | 2.0 | cm |
| $V_{cavity}$ | 21 | 169 | $cm^3$ |
| $f_{Helmholtz}$ | 1324 | 417 | mm |
| $f_{measured}$ | 1310 | 420 | mm |

Thus, FIG. 7 shows the absorption results in purely passive mode, in a test carried out within a Kundt tube, with the cavity alone (curves in solid lines) with a speaker with no power and without its seal (curves in dashed lines).

For a "large" cavity with a volume of 169 $cm^3$, the curve R1*a* shows the absorption coefficient obtained with the cavity alone, with a maximum of approximately 0.42 for the measured frequency of 420 Hz. However, for this same cavity, the curve R3*a* shows that the absorption coefficient has a greatly increased maximum which rises to 0.86 for a frequency that has shifted downwards to 316 Hz.

Similarly, for a smaller cavity of 21 $cm^3$ (with a diameter of 30 mm and a height of 30 mm), the curve R1*b* shows the absorption coefficient obtained with the cavity alone, with a maximum of approximately 0.58 for the frequency of 1310 Hz. However, for this same cavity, the curve R3*b* shows that the absorption coefficient has an increased maximum which rises to 0.72, for a frequency that this time greatly shifted down to about 930 Hz.

Compared to the sealed loudspeaker configuration, the calculation showed that the seal removal reduces the stiffness of the system to a value of 5.8 N/m instead of 819.7 N/m, in addition to implying the presence of acoustic leaks.

Therefore, in a strictly passive manner, results show that mounting such a wafer on the neck of a Helmholtz cavity, if possible very rigid and mounted in a very flexible and preferably light way, allows to obtain a cavity given an improvement of the absorption as well as a decrease of the absorption frequency.

Figure 8:
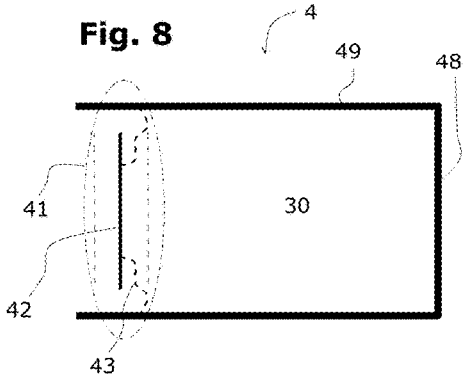
FIG. 8 is a schematic view in principle, in axial section, of an absorber according to a second example of embodiment of the invention, in a configuration with a neck forming part of the cavity.

In FIG. 8 a diagram of an absorber is presented according to a second example of embodiment of the invention, described only in how it differs from the first one, which has the characteristic of having a neck that is part of the cavity. Such a configuration, combined with the other embodiments presented here, makes it possible to vary the possibilities of configuration and agreement, and to improve the compactness and/or the ease of device manufacture.

Acoustic Wall

Figure 9:
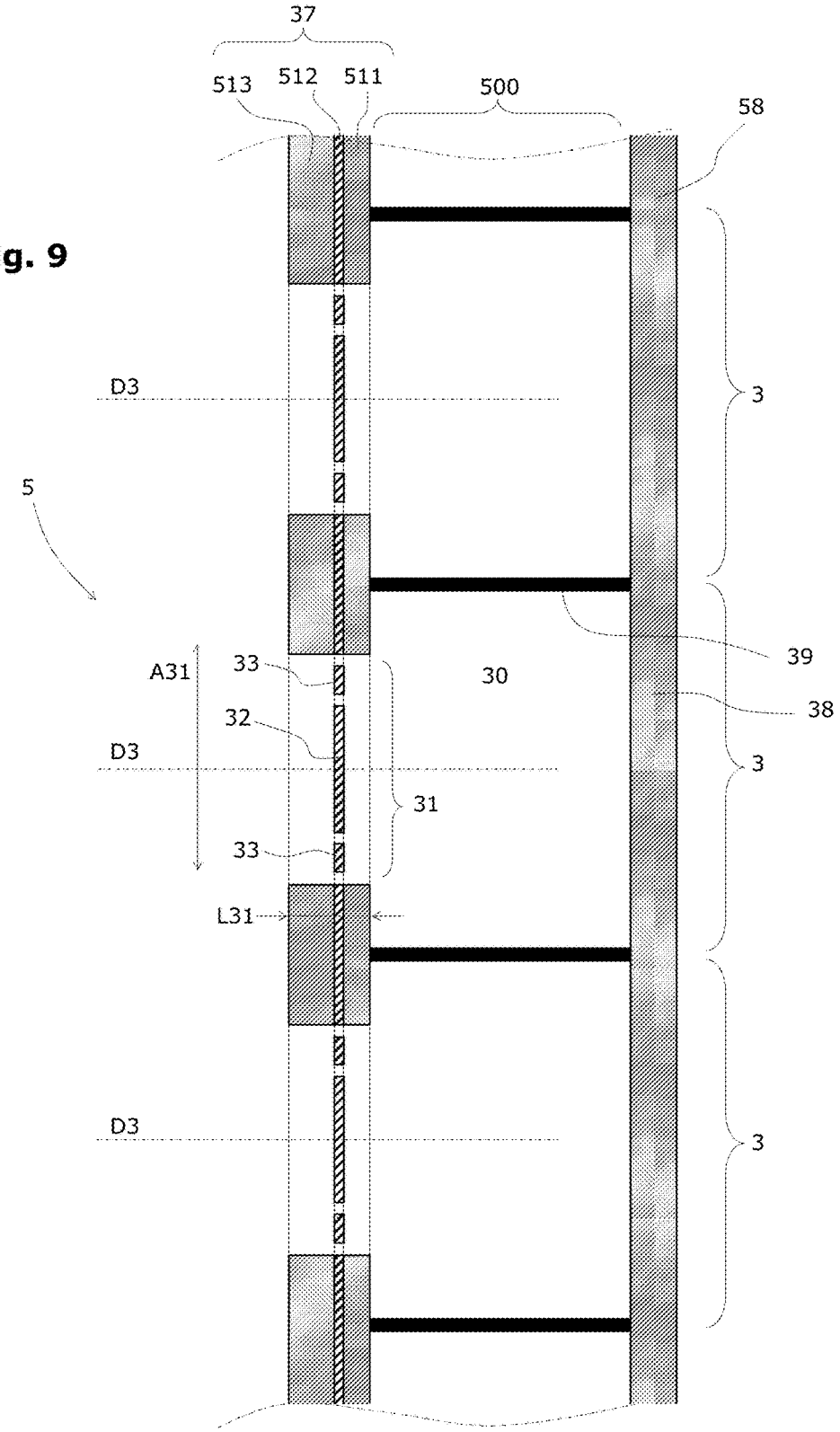
FIG. 9 is a schematic view in axial section which illustrates an acoustic wall according to a third example of embodiment of the invention comprising a multitude of absorbers, formed by a honeycomb structure covered with several perforated plates forming the neck and which enclose a cut plate to form the wafers and their suspensions.

FIG. 9 illustrates an acoustic wall 5 according to a third example of embodiment of the invention, comprising a multitude of absorbers 3, for example that of FIG. 4. This wall is formed by a plate 500 with a periodic honeycomb structure whose housings are parallel to the inlet direction D3 of its absorbers 3. This plate 500 is sealed on its rear side by a sealing layer 58, e.g. a composite layer, a sheet or a bonded sheet.

This periodic honeycomb architecture makes it possible, for example, to produce an acoustic wall comprising a very high surface density of absorbers while limiting the thickness of the assembly, even if it means using a honeycomb with large housings transversely to the input direction to obtain a large cavity volume maintaining a small overall thickness, for example less than 100 mm or less than 50 mm.

On its front side, this honeycomb plate 500 is covered with two layers 511 and 513, which are perforated to form a neck 31 of L31 length and A31 area for each housing 30 of the honeycomb. These two perforated layers 511, 513 enclose between them a plate or sheet 812 which is cut to form the wafers 32 of each absorber 3 and their suspensions 33, for example in patterns 330 as described in FIG. 4 or the like.

Such an architecture can be achieved for example with a sheet 512 of steel, or aluminium, or titanium alloy, which allows for the much cheaper and faster industrial realisation instead of the MEMS technologies of FIG. 3, which is more suitable for industrial applications of large size and/or large series, for example for jet engines or machine soundproofing.

FIGS. 10*a* and *b* illustrate an absorber 6, according to a fourth example of embodiment of the invention, alternatively within a honeycomb acoustic wall 500 similar to that of FIG. 9, and which will only be described in how it differs from the other embodiment.

In this example, the neck 61 is formed essentially by the thickness of a perforated layer 612, applied to the front side of the honeycomb. Around the neck and on each side of this thick layer 612, the advances 6140 extend inside the neck 61 and protrude above the wafer 62. These advances are distributed, sufficiently numerous and/or present on sufficiently wide angular sectors, to maintain the wafer 62 inside the neck 61 regardless of the stresses it undergoes and the position in which the absorber is positioned in relation to the force of gravity.

Inside the neck, the wafer is thus totally free to move in the input direction A3, and can be considered suspended by a zero stiffness connection, which allows to obtain performance that can be interesting in many cases.

In this example, these holding advances 6140 and 6110 are formed by an outer layer 614 plated on the outer side of the thick layer 613, and by an inner layer 611 plated on its inner side. For example, each of these holding layers 611, 640 is positioned and then cut out to form these advances, or formed by deposit in a pattern respecting the outline of the neck and the advances.

As illustrated in FIG. 10*a*, the wafer can be made from a sheet 612 sandwiched between two layers of the front side, and which is cut to form each wafer. This base plate 612 is represented here between the inner holding layer 611 and the thick layer 612, but could also be placed on the outer side or between two thick layers.

FIGS. 11*a* and 11*b* illustrate an absorber 7, of a honeycomb acoustic wall, according to two variations of a fifth example of embodiment of the invention, variation within a honeycomb acoustic wall 500 similar to that of FIG. 10, which will only be described regarding its differences from the other embodiments.

In this example, the wafer 72, 72' is also free-moving and retained by external layers 711 and 713, which protrude from the thick layer 712 above the neck 71. This wafer presented here is significantly thick in the direction of entry D3 to avoid arching and has a periphery that moulds the walls of the neck 71 so as to allow it to be guided during its movements, while leaving a leakage section to achieve the damper according to the invention.

In FIG. 11*a*, the leakage section is defined in the outer periphery of the wafer, as indicated by the arrows f72.

In FIG. 11*b*, the wafer 72' is surrounded by a sliding surface 721, forming a linear bearing which guides its movement. For example, this surface is made according to a "free" or "sliding" adjustment, i.e. just free enough to allow mobility. Such an adjustment is for instance of the H7g6 to H11d11 type according to the ISO system for metal or plastic parts, or with a clearance of less than 0.5 mm or even less than 0.2 mm or 0.1 mm for less precise manufacturing or composite materials. Such adjusted guidance can be likened to a seal, and can therefore be described as a "sliding seal". For instance, this sliding joint is covered using a conventional material such as bronze, or silicone or PTFE; the application is dry or done with a liquid film of lubricant, or a ferrofluid film. In such circumferential sealing conditions, the wafer itself has one or more through holes 731 made in the material of the wafer, which then form a leakage section f72'.

It is thus possible to make a wafer more rigid, and/or with a very small peripheral deviation without risk of jamming, more easily so than with a two-dimensional wafer like the one in FIG. 10 or with different constraints.

In FIG. 11*a*, the wafer has a closed volume all around. In FIG. 11*b*, its two end surfaces are shaped to match the wall of the neck, but are interconnected by a part of the smaller section. Such options allow for a more flexible design thanks to the experimentations with the parameters, for example the friction surface against the neck, the mass of the wafer, and/or its overall rigidity.

FIG. 13 illustrates a seventh example of embodiment of the invention, which will only be described in how its different from the other embodiments. In this embodiment, the rigid wafer also has one or more through openings 330*a* in its inner or central part.

In the half-view on the left (FIG. 13*a*), these inner openings 330*a* form a leakage section which is added to the section 330 produced around the arms 31 of the unsealed suspension, which could be similar to that of the FIG. 4.

In the half-view on the right (FIG. 13*b*), the suspension is of a sealed type, for example formed by an annular bellows made of a metal sheet or a film of plastic or polymer, for example, a Visaton K16 loudspeaker, the membrane of which forms makes for the wafer, with its seal 33*a* made out of thermoformed polymer forming the suspension. The inner openings 330*a* then form the only leakage section.

FIG. 14 illustrates an eighth example of a embodiment, which will only be described in how its different from the other embodiments.

In this mode, the wafer 92 also or exclusively includes leakage openings 930*a* located inside the wafer (i.e. the rigid part).

In the left half-view, the wafer 9*b* is formed by a layer 921 of a flexible and elastic material, for example a metal sheet or an elastomer, here of constant thickness. This elastomer can be a PDMS, or polydimethylsiloxane, a polymeric material formed from a cross linking agent and a pre-polymer, particularly with a cross linking ratio: pre-polymer of 1:10, in combination with which it is particularly flexible.

The wafer is attached to the front wall 37 by a bell-shaped annular part 931*a* with perforated parts 930*a*, which provides a non-sealed suspension. Inside the suspension 931*a*, the wafer 92*a* has a thickening providing increased rigidity in an annular region 922*a* surrounding the inner openings 930*a*. This excess thickness 922*a* is made of a different and preferably rigid material, for example an over-molding or a polymerised resin. This extra thickness, for example in its material and/or its dimensions, provides localised stiffness and additional mass that play on the characteristics of the moving equipment to obtain a movement in piston mode at the desired absorption frequency.

In the variation in the half-view on the right, described only in how its different from other embodiments, the wafer 92*b* is formed by a layer 921*b* whose thickness is increasing inwards, regarding at least or exclusively the annular extra thickness 922*b*. In this variation, and interchangeably with the left variation, the sealed suspension 931*b* is presented.

In these two variations, the inner part has a certain elasticity but is less stressed by the friction of the air since it carries the openings forming the leakage section.

The movement in "piston" mode is obtained by a greater stiffness and/or mass in the area which surrounds the suspension, with respect to the stiffness of the suspension itself, and/or by the fact that the central openings 930*a* in the central part let the air pass and undergo less effort on the part of the acoustic wave.

FIG. 15 illustrates the "piston" mode of operation as intended herein, compared with "drum mode" operation.

In FIG. 15*a*, a membrane or a plate 12 is fixed inside an orifice in a rigid wall 17. This plate 12 vibrates in "drum" mode when its centre moves along the arrow mT much more than its periphery 123, thus deforming itself by a distance $d_t$.

In FIG. 15*b*, a plate or a wafer 32 is fixed inside an orifice in a rigid wall 37 by a suspension 33. This wafer 32 vibrates in "piston" mode when its centre moves along the arrow mP almost as much as its periphery 323, for example because the suspension stiffness is very low compared to that of the wafer. For the central area 32, it may be considered that it forms a wafer moving in "piston" mode when its whole $d_p$ movement is much larger than its deformation $d_t$, or when: $d_p >> d_t$.

In this context, it can be considered that this condition is fulfilled when these two values differ by a factor of at least five, preferably 10, 50 or 100.

Absorber Variation with Loudspeaker Structure

FIG. 12 illustrates a sixth example of absorber embodiment.

This absorber 8 uses a conventional electrodynamic loudspeaker structure, here of a conical diaphragm type 82 and moving coil 824 mounted on a conventional perforated frame 85 carrying a permanent magnet 874. This structure is mounted on a front side 87, and enclosed in a cavity 80 delimited by walls 88 and 89.

The membrane 82 is connected to the front side 87 by a flexible peripheral seal 83 of a conventional type. However, contrary to what is systematically encountered and naturally expected from a loudspeaker emitting sounds such as words or music, here this seal 83 is completed by openwork cutouts 830 (represented by a dotted rectangle), completed during the manufacture process or afterwards. Similarly and according to the configurations, the seal and/or the membrane 82 and/or "spider" 84 which connects the top of the cone 82 to the frame 85 may also be perforated by cutouts 840. Alternatively or additionally, (not shown here) the membrane itself comprises perforated parts forming all or part of the leakage sections.

Such absorber is represented here in a version including the electromagnetic activation system 824, 874. This version can be used passively, by not connecting the coil or disconnecting it from the control unit. It can also be used in a hybrid manner by activating the loudspeaker to achieve active absorption in addition to the modified Helmholtz resonance. It can also be used in multi-function mode, for example to achieve absorption (active or passive) at certain times and use as a classic loudspeaker at other times.

In its purely passive version, the absorber can also be completed with a speaker structure performed incompletely, i.e. with the same mechanical structure but without the electromagnetic system.

Such an architecture can be particularly interesting for large rooms, and/or walls of large sizes, in which integration and thickness are less important constraints. It can make it possible to place one or more absorbers in specific locations of the wall or the room, possibly in versions of different sizes and frequencies, and in varying numbers depending on the demand.

In its complete version with the electrodynamic motor, this absorber can be also used in active mode, acoustic impedance matching and/or active reduction mode.

FIG. 16 illustrates the MEMs-type loudspeaker shown in FIG. 5, installed with its electrodynamic motor 374, 324 in the neck 31 of the absorber of FIG. 3, e.g. for use in active mode, with adaptation of acoustic impedance and/or active reduction.

Of course, the invention is not limited to the examples which have just been described and many adjustments can be made to these examples without leaving the scope of the invention.

The invention claimed is:

1. An acoustic absorber device, notably passive absorber, comprising: an enclosure delimiting a cavity opening outwardly into an inlet direction through at least one orifice passing through a front wall of a determined thickness, thereby forming a neck having a determined opening surface and a determined length, the dimensions of said enclosure and said neck being determined to together form a Helmholtz resonator for a first frequency or frequency range, called natural frequency;

at least one mobile element, or wafer, is suspended to said enclosure by one or more mechanical connections, or suspensions, in a position partially obstructing said at least one neck, i.e. unsealed on all or part of its stroke; and the stiffness of the suspensions and the stiffness of the wafer are determined in their combination, particularly in their ratio, so that said wafer vibrates in a "piston" type resonance mode along the direction of the incident wave, at a second frequency or frequency range different from the first frequency, particularly lower, thereby achieving absorption for this second frequency or frequency range.

2. The device according to claim 1, characterised in that the wafer is made of one or more materials chosen from silicon, quartz, alumina, titanium and its alloys, steel, aluminium and its alloys, plastics and notably polymers.

3. The device according to claim 1, characterised in that the suspensions are made of a material and using a geometry providing an elastic behaviour, with stiffness for the movement of the wafer in its periphery of less than 6 N/m, and in particular of less than 2 N/m for a wafer of average diameter between 10 mm and 20 mm.

4. The device according to claim 1, characterised in that the suspensions comprise elongated arms connecting the wafer to the enclosure in a shape extending around said wafer parallel to the edge of the neck and/or the wafer.

5. The device according to claim 4, characterised in that the wafer is made within a plate or a sheet integral with the enclosure, by a part rendered mobile with respect to said enclosure by means of one or more cutouts made in said plate or sheet so as to form suspension arms.

6. The device according to claim 1, characterised in that the wafer is held in the neck by one or more advances protruding from the neck at both ends to extend in front of the periphery of the wafer so as to form a stop preventing said wafer from escaping from the neck.

7. The device according to claim 1, characterised in that the wafer has a periphery which conforms to the inner surface of the neck with a determined deviation over a sufficiently determined length, in combination with said deviation and with the nature of the materials of the neck and the wafer, to allow said wafer to move along the neck without causing its blocking by tilting and arching.

8. The device according to claim 1, characterised in that the wafer is formed by a diaphragm of speaker fixed to an outer frame by a flexible peripheral seal, and in that said seal has one or more cutouts surrounding said wafer over at least 20% of its periphery, and in particular at least 40%.

9. The device according to claim 1, characterised in that the wafer further interacts with the enclosure by an electromagnetic system so as to form the membrane of a loudspeaker, and in that said electromagnetic system is controlled by an electronic circuit:

in order to achieve active acoustic absorption, and/or so as to modify the acoustic impedance of said loudspeaker to enhance absorption, shift the absorption frequency, widen the absorption frequency range, or a combination of these effects.

10. A sound absorbing wall comprising a multitude of devices according to claim 1, juxtaposed within a continuous two-dimensional array to provide acoustic absorption in a common direction.

11. The wall according to claim 10, characterised in that it comprises a plate with a honeycomb structure whose housings form a multitude of cavities which are closed on a so-called rear side, and whose cavities are covered on one front side by one or more walls cut to form a multitude of necks each receiving a wafer.

12. A process for the industrialisation of an acoustic absorber according to claim 1, intended to absorb a target frequency, comprising:

a step of determining dimensions of a cavity provided with a neck so that said cavity and said neck form a Helmholtz cavity having a first frequency Helmholtz resonance higher than the target frequency; and a step of determining characteristics of a suspended wafer adapted to be arranged in the neck of said cavity so as to produce an absorber tuned to a second frequency corresponding to said target frequency.

13. The method according to claim 12, wherein the suspended wafer is determined so that the suspension of the absorber has its first normal mode of deformation at a frequency lower than the second frequency.

14. The method according to claim 13, characterized in that the wafer of the acoustic absorber is determined so as to have, when it is free, its first normal mode of deformation at a frequency higher than the second frequency.

15. A method of manufacturing an absorber according to claim 1, characterised in that it comprises at least one step of cutting out a sheet or plate so as to form one or more acoustic absorber wafers.

16. The method according to claim 15, characterised in that the plate or sheet is fixed to the surface of a plate having a honeycomb structure, and in that the cutting out step produces a plurality of wafers distributed with respect to the housings of the honeycomb structure so as to form the plurality of wafer of an acoustic wall whose housings form a multitude of cavities which are closed on a so-called rear side, and whose cavities are covered on one front side by one or more walls cut to form a multitude of necks each receiving a wafer.

* * * * *